US005203817A

United States Patent [19]

Klumpjan

[11] Patent Number: 5,203,817

[45] Date of Patent: Apr. 20, 1993

[54] FENCE POST BRACKET

[76] Inventor: Joe Klumpjan, 1334 Sunset Dr., Rte. 3, Campbellsport, Wis. 53010

[21] Appl. No.: 826,544

[22] Filed: Jan. 27, 1992

[51] Int. Cl.[5] ..... E02D 27/42

[52] U.S. Cl. ..... 52/298; 52/170; 52/296; 256/19

[58] Field of Search ..... 52/298, 295, 296, 297, 52/170; 256/19, 59

[56] References Cited

U.S. PATENT DOCUMENTS

| | | | |
|---|---|---|---|
| 505,156 | 9/1893 | Camp | 52/297 |
| 574,641 | 1/1897 | Streator | 52/170 |
| 575,035 | 1/1897 | Marble . | |
| 685,186 | 10/1901 | Snider | 52/297 |
| 772,928 | 10/1904 | Dunlap | 52/298 |
| 844,726 | 2/1907 | Hunter | 52/298 |
| 951,142 | 3/1910 | Murray . | |
| 953,060 | 3/1910 | Ross | 52/298 |
| 1,544,863 | 7/1925 | Ross . | |
| 4,096,677 | 6/1978 | Gilb . | |
| 4,199,908 | 4/1980 | Teeters . | |
| 4,359,851 | 11/1982 | Daniels | 52/298 |
| 4,387,543 | 6/1983 | Tschan et al. . | |
| 4,543,757 | 10/1985 | Cosgrove . | |
| 4,614,070 | 9/1986 | Idland . | |
| 4,644,713 | 2/1987 | Lehman . | |
| 4,924,648 | 5/1990 | Gilb et al. . | |
| 4,995,206 | 2/1991 | Colonias et al. . | |

*Primary Examiner*—Michael Safavi

*Attorney, Agent, or Firm*—Andrus, Sceales, Starke & Sawall

[57] ABSTRACT

A fence post bracket is stamped from a single sheet of material and includes a back wall and three side walls for supporting a fence post on the major portion of its perimeter. The fence post side walls terminate in a plurality of legs providing for multiple point support of the fence post in a concrete embedded post hole. The bottom of the fence post is supported above ground level and is unencumbered to provide for complete drainage of the fence post, minimizing deterioration of the fence post due to moisture retention.

5 Claims, 1 Drawing Sheet

FENCE POST BRACKET

BACKGROUND OF THE INVENTION

1. Field of the Invention

The subject invention is generally related to fence posts and is specifically directed to a bracket for supporting a fence post above ground level to allow for drainage.

2. Description of the Prior Art

The fence post brackets for supporting fence posts have been known for approximately 100 years.

For example, U.S. Pat. No. 575,035 issued to A. Marble on Jan. 12, 1897 shows a pair of elongate braces adapted to be embedded in concrete for supporting the opposite sides of a fence post which is bolted in place between the brackets. Over the years, various modifications to fence post brackets have been devised and patented. As shown in U.S. Pat. No. 1,544,863 issued to A. Ross on Jul. 7, 1925, a bracket having a plurality of elongate braces and secured around the fence post by arcuate clamps is mounted on the fence post before the entire assembly is embedded in a concrete filled hole.

More recent developments are shown in U.S. Pat. No. 4,096,677 issued to T. Gilb on Jun. 27, 1978. The bracket shown in the Gilb patent is a circular clamp which substantially surrounds the fence post and is secured to the post via through bolts. The lower end of the bracket terminates in a perforated base which is adapted to receive concrete for more securely holding the fence post in place in a concrete filled hole.

An adjustable bracket is shown in U.S. Pat. No. 4,199,908 issued to D. Teeters on Apr. 29, 1980. The Teeters bracket includes a substantially U-shaped outer brace for securing the post in a concrete embedded hole and a platform which is secured between the brace for supporting the bottom of the post.

U.S. Pat. No. 4,644,713 issued to J. Lehman on Feb. 24, 1987 discloses a bracket having three upstanding walls to be secured to the three sides of a square post, with a bottom for supporting the posts and a tapered, hollow tubular leg for supporting the post and bracket when it is driven into the ground.

SUMMARY OF THE INVENTION

The fence post support brace of the subject invention provides means for solidly supporting a post above a concrete embedded hole by securing the post on the majority of its perimeter. The bottom of the post is supported above ground level and is unencumbered, permitting ready drainage of moisture from the post to minimize deterioration of the fence post.

The fence post bracket of the subject invention is unique in that it provides for solid support of the fence post maintaining it in a rigid vertical position, with the bracket being securely embedded in a concrete filled hole on each corner or edge of the bracket, greatly improving the rigidity of the assembly. The bracket may be stamped from a single sheet of metal and formed by simply folding the metal at two points to provide for an interior post supporting surface of square or rectangular cross section. In the preferred embodiment of the invention, a plurality of brackets may be made from a single sheet of material with minimum waste by staggering the legs of the bracket of a plurality of brackets as the brackets are laid out on the sheet. The bracket may be made of galvanized steel or a similar weather resistant material to increase its life.

In experimental use, the open bottom bracket of the subject invention has provided for excellent drainage of a wood post, greatly enhancing the life of the wood post by minimizing deterioration due to moisture.

The fence post bracket of the subject invention provides for a fence post support supporting the post on a major portion of its perimeter, while keeping the bottom of the post free and clear of the surrounding ground and while rigidly supporting the post in an upright position by providing for a plurality of structural support members, one at each corner of the post, for securing the post in a concrete filled post hole.

It is, therefore, an object and feature of the subject invention to provide for a fence post bracket maintaining the bottom of the post above ground level in an unencumbered manner for permitting full drainage of moisture from the post.

It is another object and feature of the invention to provide for a fencepost bracket which is adapted for supporting the post on a major portion of its perimeter to provide for a rigid assembly.

It is yet another object and feature of the subject invention to provide means for a fence post bracket adapted to be embedded in a concrete filled post hole for securing the post in the hole at each corner of the post.

Other objects and features of the invention will be readily apparent from the accompanying drawings and description.

DETAILED DESCRIPTION OF THE PREFERRED EMBODIMENT

Figure 1:
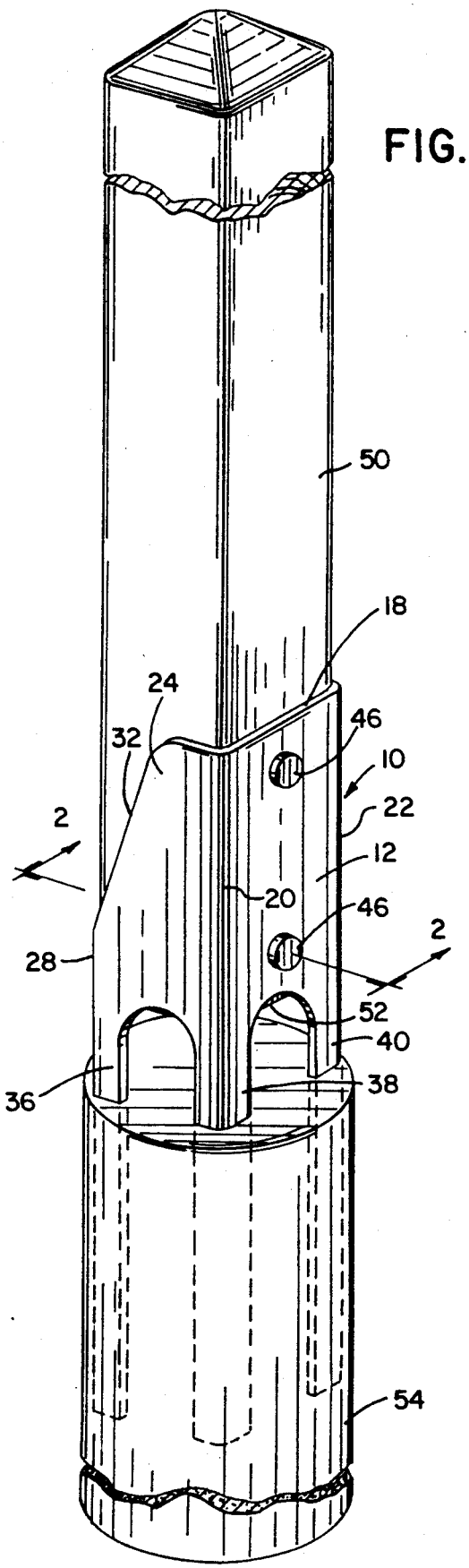
FIG. 1 is a perspective view of a fence post bracket and fence post in accordance with the subject invention.
Figure 3:
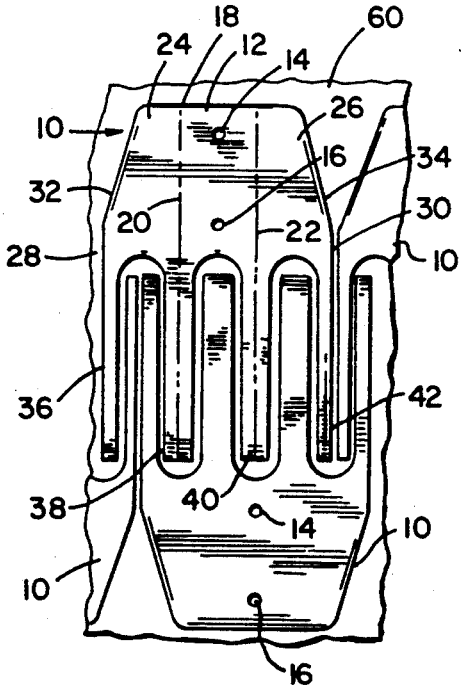
FIG. 3 illustrates the fence post bracket in its unassembled condition.

As shown in FIG. 1, the fence post bracket 10 of the subject invention is made of an integral stamped, formed sheet metal such as galvanized steel or the like and includes a back panel 12 having a plurality of through holes 14 and 16 (see FIG. 3). The panel 12 includes a top edge 18 and side edges defined by the corner bends 20 and 22. The outer side walls or panels 24 and 26 (see FIG. 3) project outwardly from the respective corners 20, 22, and a respective outer edge 28, 30.

In the preferred embodiment, the outer edges 28, 30 are tapered, as shown at 32, 34 into the upper edge 18.

Each of the panels 12, 24 and 26 have a lower end which is formed into a plurality of legs 36, 38, 40 and 42. When the bracket 10 is folded into shape along the corner lines 20 and 22, the legs 38 and 40 are folded into an L-shaped cross section and the legs 36 and 42 are at the outer edges of the bracket. This provides four point support of the post 50 when the bracket is secured in the post hole 62 which is filled with concrete 53 or the like.

Figure 2:
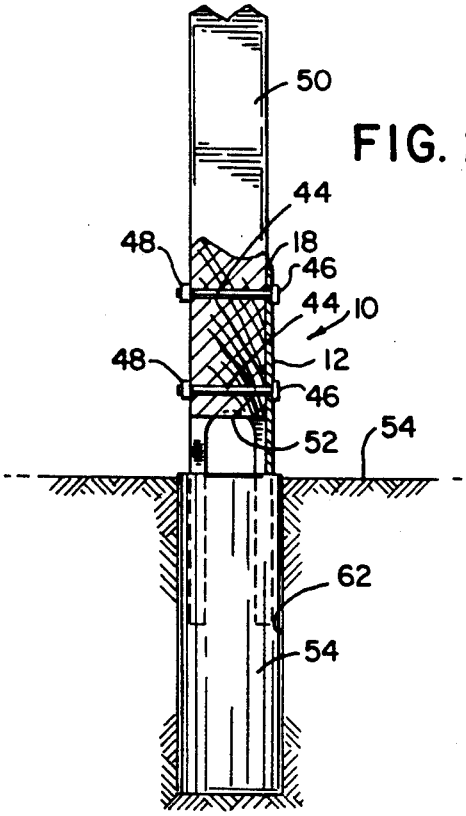
FIG. 2 is a section view taken along the line 2—2 of FIG. 1.

As is best shown in FIG. 2, the post 50 is secured in the bracket 10 via a pair of through bolts 44 which are received in the holes 14 and 16 in the bracket. The bolt heads 46 are larger than the holes 14 and 16, providing a secure assembly between the bracket and the bolts. In the preferred embodiment, the bolts 44 are threaded and adapted to receive nuts 48, by which the post 50 may be tightened against the back wall 12 of the bracket. The side walls 24 and 26 are adapted to engage and securely support the sides of the fence post, providing rigid support for the fence post along three of its four sides.

As can be seen in FIGS. 1 and 2, the fence post bracket 10 of the subject invention includes smooth interior walls, whereby the bottom 52 of the fence post is encumbered, providing for free drainage.

As is clearly shown in FIG. 2, the bottom 52 of the fence post is supported above ground level 54, permitting complete drainage of the post, minimizing deterioration of the post which is caused by the tension of moisture.

It is an important feature of the subject invention that the bracket 10 can be constructed from a single piece of flat sheet material through a single stamping operation. As is best shown in FIG. 3, the back wall 12, side walls 24 and 26, and legs 36, 38, 40 and 42 are all integrally formed form a single sheet. Once the basic form is stamped or cut from the sheet, it is folded along fold lines 20 and 22 define the corners between the back and side walls. A plurality of brackets 10 may be constructed from a single flat sheet 60 by staggering alternating legs of various brackets 10, minimizing the amount of scrap created in the manufacture of the fence post.

While certain features and embodiments of the invention have been specifically described herein, it will be readily understood that the invention encompasses all enhancements and modifications within the scope and spirit of the following claims.

I claim:

1. A fence post assembly for rigidly securing an elongated wooden fence post having a perimeter of rectangular cross-section, a top end and a bottom end in a fixed position with the bottom end of the post spaced upwardly from a post hole in the ground, the assembly comprising:

a. a substantially vertical support bracket adapted for receiving the fence post adjacent its bottom end and for circumscribing three sides of the perimeter of the fence post, the support bracket including three vertical walls intersecting at right angles to form three sides of a rectangle corresponding to the post cross-section, wherein the fence post may be inserted into the bracket through the remaining open side;

b. each of said vertical walls including opposite ends, wherein corners are defined by abutting ends of the walls, and wherein a leg depends from each of the corners and each of the free outer ends to define open spaces bounded by adjacent pairs of legs and a lower edge of the wall interconnecting each respective leg pair;

c. means for releasably securing the fence post to the support bracket with the bottom end of post substantially above the legs; and d. a cylindrical concrete base into which the ends of said legs depending from the support bracket are embedded leaving upper portions of said spaces open and for holding the fence post in a substantially vertical position, whereby the bottom end of the fence post is free of contact with any portion of the concrete base to provide for drainage of the fence post and the open side of said bracket and the upper portions of said open spaces provide open circulation to the post bottom from all directions.

2. The fence post holder of claim 1, wherein the means for releasably securing the fence post to the bracket comprises a plurality of through bolts passing through the fence post and the bracket and a plurality of locking nuts adapted to be threadably secured on the bolts.

3. The fence post holder of claim 1, wherein the support bracket and legs are formed from a flat sheet of bendable, rigid material.

4. The fence post holder of claim 3, wherein the support bracket and legs are constructed of a galvanized steel alloy.

5. The fence post holder of claim 3, wherein a plurality of fence post holders may be formed from a single flat sheet with the legs of different holders staggered and interspersed for minimizing scrap.

* * * * *